US005483865A

United States Patent [19]

Brunand

[11] Patent Number: 5,483,865

[45] Date of Patent: Jan. 16, 1996

[54] AIRCRAFT SIGHTING SYSTEM

[75] Inventor: Jacques Brunand, La Fare Les Oliviers, France

[73] Assignee: Eurocopter France, Marignane, France

[21] Appl. No.: 236,442

[22] Filed: May 2, 1994

[30] Foreign Application Priority Data

Jun. 9, 1993 [FR] France ..... 93 06919

[51] Int. Cl.[6] ..... F41G 5/18

[52] U.S. Cl. ..... 89/41.21; 89/41.06; 89/41.07; 348/167; 342/66; 342/67

[58] Field of Search ..... 89/41.06, 41.07, 89/41.14, 41.21; 342/13, 20, 59, 66, 67; 250/208.1, 332, 334; 348/144, 145, 146, 148, 159, 166, 167, 168

[56] References Cited

U.S. PATENT DOCUMENTS

| | | | |
|---|---|---|---|
| 2,420,334 | 5/1947 | White et al. | 342/67 |
| 3,457,827 | 7/1969 | Sumrall | 89/41.06 |
| 3,641,261 | 2/1972 | Chaplin et al. | 89/41.21 |
| 3,711,638 | 1/1973 | Davies | 89/41.05 |
| 3,924,232 | 12/1975 | Burdi et al. | 342/20 |
| 4,202,246 | 5/1980 | Schertz et al. | 89/41.21 |
| 4,779,095 | 10/1988 | Guerreri | 348/148 |
| 5,223,839 | 6/1993 | Grossman | 342/43 |
| 5,359,920 | 11/1994 | Muirhead et al. | 89/41.21 |

FOREIGN PATENT DOCUMENTS

| | | |
|---|---|---|
| 0031781 | 7/1981 | European Pat. Off. . |
| 0127914 | 12/1984 | European Pat. Off. . |
| 0167432 | 1/1986 | European Pat. Off. . |
| 0424238 | 4/1991 | European Pat. Off. . |
| 2525761 | 10/1983 | France . |
| 3630701 | 3/1987 | Germany . |

OTHER PUBLICATIONS

Keirstead et al, "Aircraft Survivability in the 21st Century–ATIRCM", Journal of Electronic Defense, May 1992.

*Primary Examiner*—Stephen C. Bentley

*Attorney, Agent, or Firm*—Marshall, O'Toole, Gerstein, Murray & Borun

[57] ABSTRACT

The present invention relates to a sighting system for an aircraft, in particular a rotary wing aircraft such as a helicopter. According to the invention, the sighting system comprises, in combination, an observation first individual apparatus integrated in the sides of the aircraft, and an axial fire second individual apparatus integrated at the front of aircraft, said first and second apparatuses being connected to the onboard computer of the aircraft.

28 Claims, 4 Drawing Sheets

AIRCRAFT SIGHTING SYSTEM

The present invention relates to a sighting system for an aircraft, in particular a rotary wing aircraft such as a helicopter.

BACKGROUND OF THE INVENTION

Analyses of the missions performed by and of the weapons aboard aircraft, in particular helicopters, have shown the need for both of the following:

an omnidirectional observation and detection function for target searching and for controlling the mission; and a firing function that must firstly be rapid over a wide angular field both for target designation and for reflex firing of weapons for self-protection, and that must secondly be accurate over a narrow field of a few tens of degrees centered on the longitudinal axis of the aircraft for use with long-range weapons.

Patent EP-0 167 432 discloses an airborne system for detecting, locating, and tracking a target, the system comprising a pivotable optical head placed beneath a dome outside the fuselage of the aircraft. The optical detection and telemetry means are installed in a gimbal type mounting comprising two frames that are mutually perpendicular.

In addition, the optical sighting system for aircraft described in patent EP-0 127 914 is mounted in a pod including a first portion that is fixed to the aircraft, a second portion that is pivotable relative to said first portion about a first axis, and a third portion pivotable relative to said second portion about an axis orthogonal to the first-mentioned axis.

Also, patent FR-2 570 195 relates to apparatus for target searching, comprising a camera mounted on a tilting stabilization platform mounted on board an aircraft. In particular, the movement of the stabilization platform may be movement that is triangular, sinusoidal, sawtooth, or spiral.

In each of those cases, it thus appears that the sighting system is mounted outside the aircraft on a stabilized platform or the like whose description and hardware architecture show up difficulties of integration because such electromechanical equipment is heavy, bulky, and complex, and difficult to adapt to different carriers and weapons.

OBJECTS AND SUMMARY OF THE INVENTION

An object of the present invention is to avoid the above drawbacks, and it relates to a sighting system that is easily integrated in the carrier (aircraft) and that can easily be adapted to different carriers, missions, and weapons.

To this end, a sighting system for an aircraft, in particular a rotary wing aircraft such as a helicopter, is remarkable, according to the invention, in that it comprises in combination observation first individual apparatus integrated in the sides of the aircraft and axial fire second individual apparatus integrated at the front of the aircraft, said first and second apparatuses being connected to the onboard computer of the aircraft.

Thus, unlike prior art combined apparatuses mounted on moving supports (masts, platforms, pods), the combination of separate observation and aiming apparatuses in accordance with the invention constitutes an architecture that is original because of the specific fixed installation of said apparatuses integrated with the aircraft.

Because of its modular nature, the architecture of the sighting system of the invention is capable of satisfying all existing and planned operational needs while also satisfying the numerous constraints on implementing such functions on an aircraft, in particular a rotary wing aircraft such as a helicopter. The modular nature of the architecture makes it possible, in particular, to configure the weapon-carrying aircraft rapidly for a specific mission and a given weapon by installing appropriate detectors and guidance equipments, and by reducing the constraints on integrating and harmonizing the equipments on the weapon-carrying aircraft.

Sighting functions are thus shared between two main components:

- a component that performs the functions of omnidirectional watch-keeping, of observation, and of pointing ("observation apparatus") that:
  - is capable of detecting air and ground targets automatically;
  - provides capacity for observing a small field telescopically with determined magnification to confirm detection and to recognize targets; and
  - enables targets that are distant and far removed from the axis to be taken over by the "axial fire device" that controls fire on the axis, after the aircraft axis has been swung onto the target; and
- a component for firing on the axis, that provides high performance from the point of view of quality of visionics and of accuracy of pointing and of harmonization of the optical paths of the various sensors, but is not very complex because there is no need for their supports to be pivoted and stabilized (the term "sensor" as used herein applies to an optoelectronic detection apparatus).

Advantageously, the first observation apparatus comprises two sensors integrated directly on the fuselage of the aircraft on respective opposite sides of its longitudinal axis, each covering about 180° in relative bearing and 20° to 40° in elevation. That makes it possible to cover a bearing scan over a full 360°.

In particular, each sensor has a plurality of elementary detectors, and includes first optical scanning means comprising a bearing scanning prism enabling a bearing scan sheet to be obtained, and a prism for tilting said sheet enabling elevation scanning to be performed.

Further, each sensor may include a second optical system enabling a fraction of the total field to be scanned, which second optical system comprises a bearing scanning mirror rotating at low speed and a retractable lens.

Also, the axial fire second apparatus may either be integrated in the nose of the aircraft, or else it may be integrated in the aircraft above its cockpit.

Advantageously, the axial fire second apparatus comprises a thermal camera having two simultaneous fields, namely a large field for acquiring targets, and a small field for identifying and engaging a determined target at long range.

Preferably, the observation first apparatus and the axial fire second apparatus operate in the 8 micrometer to 12 micrometer band (infrared range).

In addition, the observation first apparatus may also operate in the 3 micrometer to 5 micrometer band, and/or in the 0.45 micrometers to 0.9 micrometer band, and may also be associated with a radar.

According to other characteristics of the invention, the sighting system includes means for memorizing targets detected by the observation first apparatus and/or alarms associated with the observation first apparatus and active for fire control purposes.

Advantageously, sensors operating in the infrared or in the visible spectrum enable the aircraft to be piloted in fire control mode.

Preferably, symbology of different colors is used as a function of the results of the identification friend or foe procedure.

Also, the observation apparatus may present a display by means of a helmet-mounted sight, and the axial fire apparatus may present a head-up display or a "head halfway" display. Optionally only the firing symbology is shown on its own on a head-up brilliant sight.

BRIEF DESCRIPTION OF THE DRAWINGS

The figures of the accompanying drawings show clearly how the invention can be implemented.

MORE DETAILED DESCRIPTION

Figure 1:
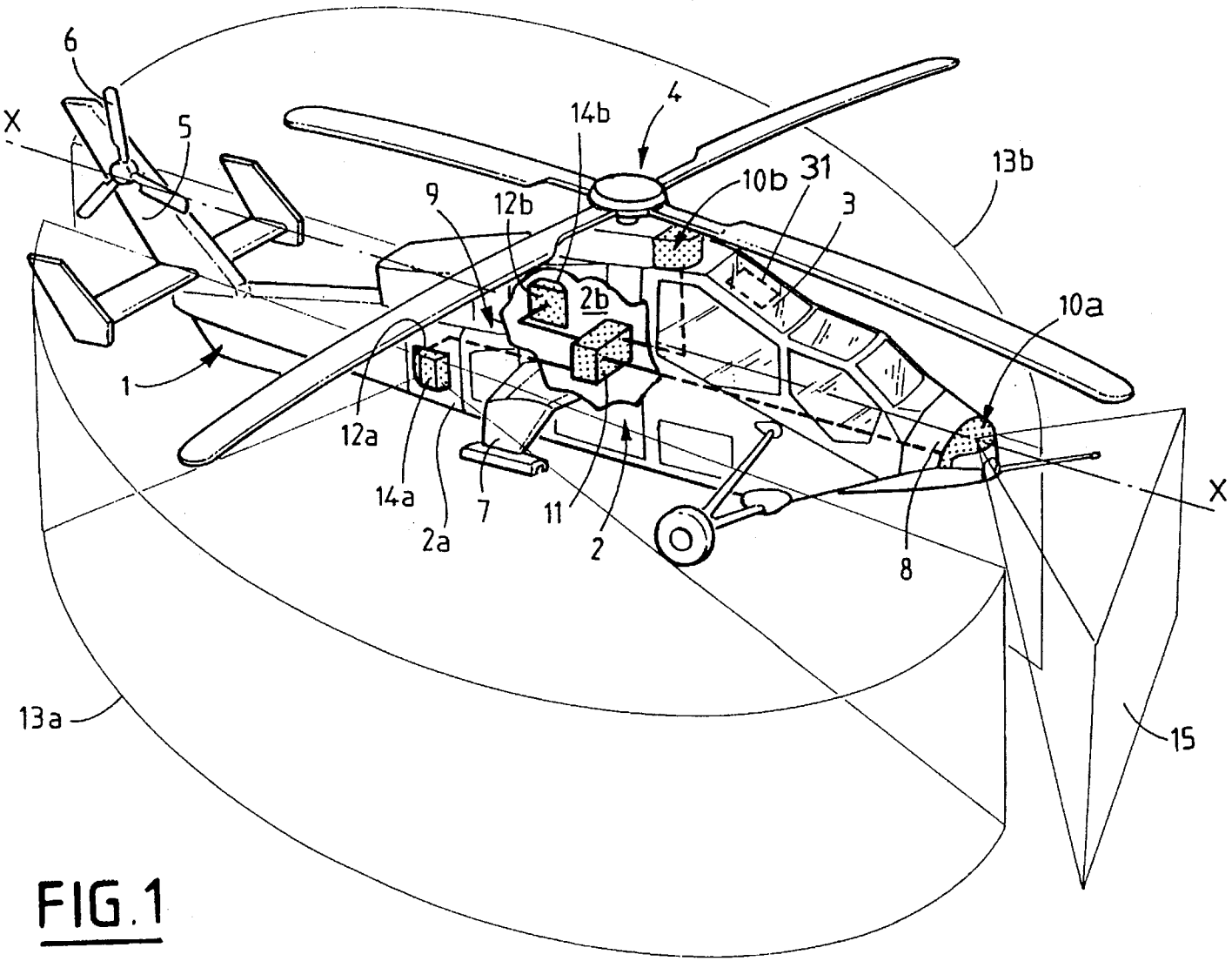
FIG. 1 is a diagrammatic perspective view of a helicopter showing how the sighting system of the invention is installed.

In conventional manner, the helicopter 1 shown in FIG. 1 essentially comprises a fuselage 2 that extends along the longitudinal axis X—X of the helicopter, a cockpit 3, a rotary wing 4, and a tail 5 provided with an antitorque propeller 6. It also has two stub wings 7 (only one is visible in FIG. 1) for receiving weapons (missiles, rockets), and a cannon may optionally be housed in the nose 8 of the machine.

The sighting system of the invention comprises a combination of a first individual apparatus 9 for observation purposes integrated in the side of the aircraft (in this implementation, the helicopter 1), and a second individual apparatus 10 (which may be either 10*a* or 10*b* in FIG. 1) for axial firing purposes integrated in the front of the aircraft, with the first and second apparatuses 9 and 10 being connected to the onboard computer 11 of the aircraft.

More precisely, the observation apparatus 9 comprises two optoelectronic sensors 12*a*, 12*b* integrated directly on the fuselage 2 of the helicopter 1 on respective opposite sides of its longitudinal axis X—X, i.e. each of them is integrated on a corresponding flank 2*a*, 2*b* of the helicopter, and each of them covers about 180° in relative bearing and 20° to 40° in elevation, as represented by observation volumes 13*a* and 13*b* in FIG. 1. Angular observation cover can thus be obtained over 360°. In addition, as can be seen in FIG. 1, each sensor 12*a*, 12*b* has an optical window with three plane panes 14*a*, 14*b*. It will also be observed that the field covered by the axial fire apparatus 10 is given reference numeral 15. The axial fire apparatus 10 may be integrated either in the nose 8 of the helicopter (designated 10*a* in FIG.) or else in the helicopter above the cockpit 3 (designated 10*b* in FIG. 1).

Figure 2:
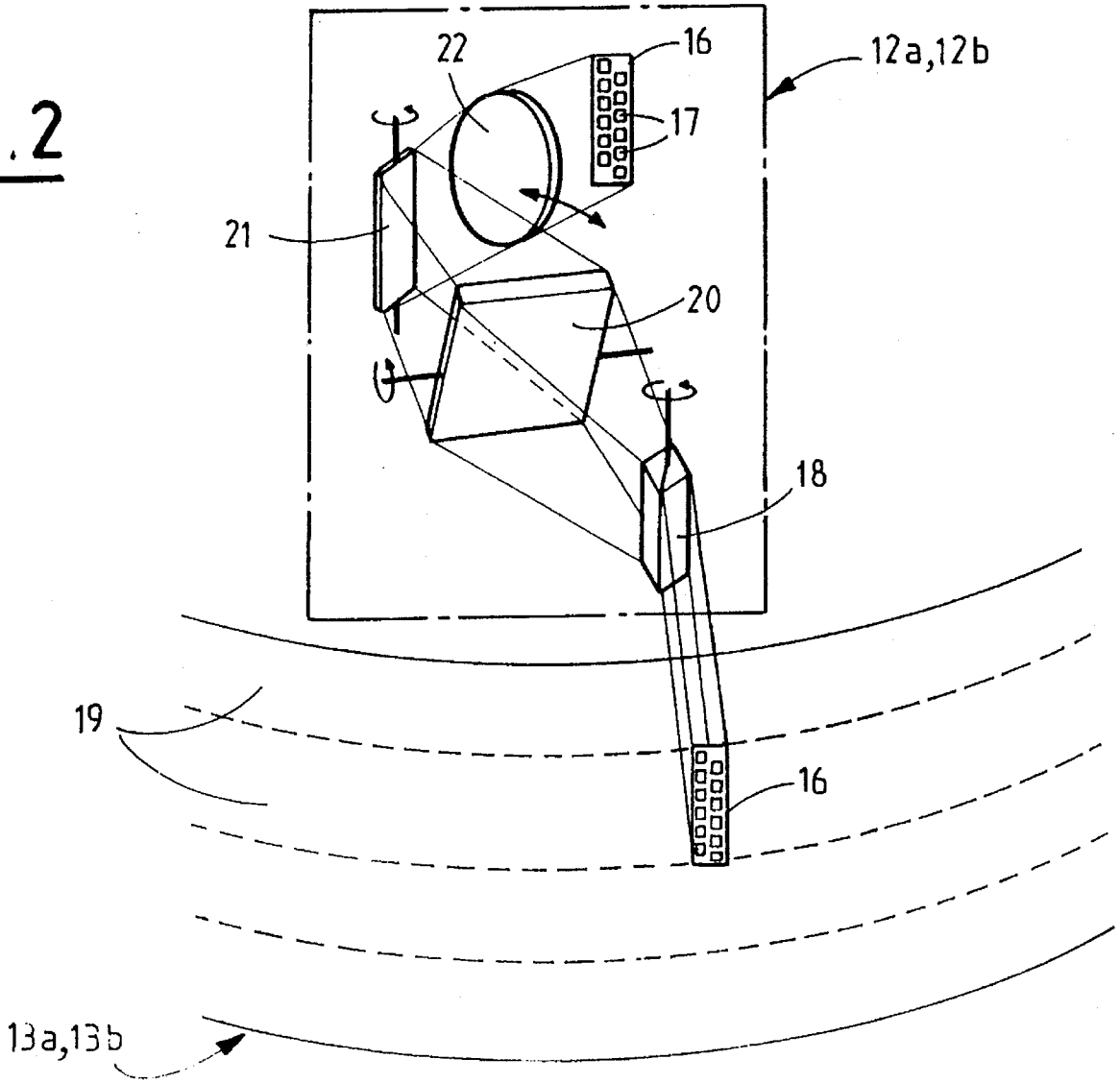
FIG. 2 is a simplified diagrammatic view of the optical system for a sensor of the observation apparatus.

FIG. 2 shows the optical system of each of the sensors 12*a*, 12*b* . Each sensor 12*a*, 12*b* has a matrix 16 of elementary detectors 17 with the conjugate of the matrix of detectors being moved through object space by a first scanning optical system comprising a bearing scanning prism 18 capable of performing an excursion of 180°, thereby obtaining a bearing scan sheet 19, while a sheet tilting prism 20 serves to perform elevation scanning, the entire system serving to superpose horizontal sheets 19 that cover 180° in relative bearing and 20° to 40° in elevation.

For a given position of the two prisms 18 and 20 (bearing and elevation), a second optical system serves to scan a fraction of the total field (about 1° by 1° from within the 180° by 40°). This second optical system comprises a bearing scanning mirror 21 which reciprocates at low speed over a limited fraction of the total field, thereby receiving more photons and thus enabling better contrast to be obtained (better resolution). By installing a retractable lens 22 (magnifying glass) it is also possible to obtain better definition of the image. In addition to the bearing scanning over a small field, it would also be possible to provide elevation scanning over the same field and for the same purpose.

The observation apparatus 9 is required to perform two main functions:

an automatic panoramic watch-keeping function; and a function of performing observation over a small field that is steerable by remotely-controlled pointing.

For the first function, which consists in passively detecting air or ground targets, the most suitable spectrum band has to be the 8 micrometer to 12 micrometer band (in the infrared). It is possible to envisage additionally using the 3 micrometer to 5 micrometer band.

The second function may be implemented by a mode in which the total field of the first function is subscanned by means of the second optical system 21, 22 described above. The gain in range compared with the first function is obtained by increasing the integration time of the elementary detectors (which may go as far as completely stopping scanning) and, optionally, by interposing the focusing lens 22 that is specific to this mode. The required field value is of the order of one degree. In this mode of use, the 8 micrometer to 12 micrometer spectrum band provides the operator with the advantages and the drawbacks of thermal imaging. The utility of associating this with image intensification using visible light (0.45 micrometers to 0.9 micrometers) may be envisaged. The advantage of image intensification is to provide the operator with a visible type image and to make it possible to continue working under conditions of loss of thermal contrast as are encountered under heavy rain or under strong winds, and also under conditions of temperature inversion. However, it is then necessary to install a second sensor and a second optical path in the absence of materials that are transparent both at 8–12 micrometers and at 0.45–0.9 micrometers.

The first function of keeping watch may be assisted by means of an active electromagnetic sensor that presents the advantages specific to radar detection (range, all-weather ability, Doppler effect detection). However, such active apparatus is ineffective for detecting objects on the ground (apart from helicopters lying in ambush) and presents the drawback of not being discrete, which is a drawback inherent to the principle of detection by radar.

The third function of this observation apparatus 9 may also be pointing and using weapons. This requires angle and distance measurements to be performed. Angles are measured by noting the position of the optical scanning means. Distances are measured by stadiometry, triangulation or telemetry.

The axial firing apparatus 10 is constituted by various elements that are selected depending on the mission and weapons configuration of the helicopter. These elements are mounted directly on the structure of the helicopter 1. They are harmonized with one another and with the structure by means of an integrated system or a harmonization bench on the ground.

Figure 3:
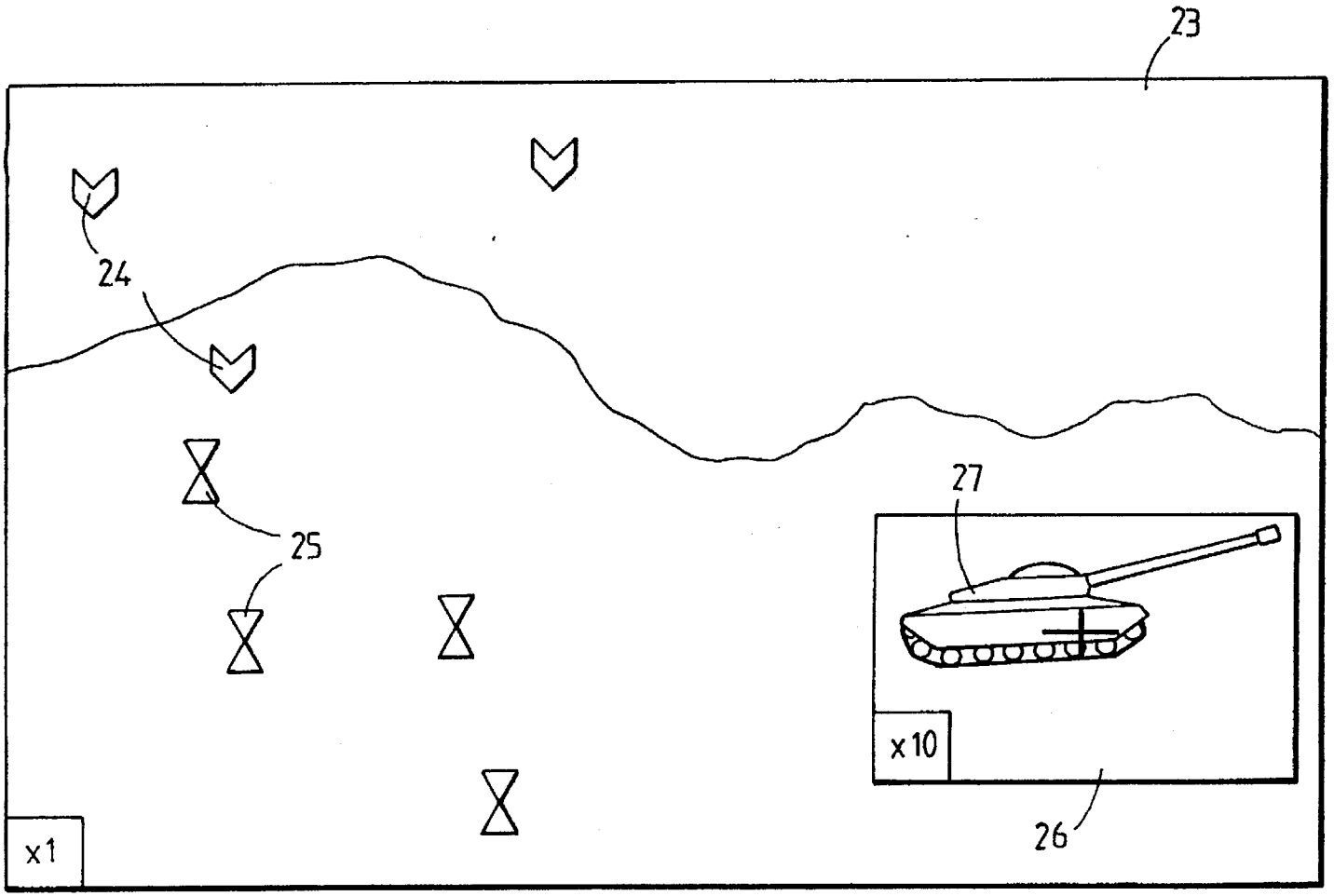
FIG. 3 shows two simultaneous images provided by the two-field thermal camera of the axial fire apparatus.
Figure 4:
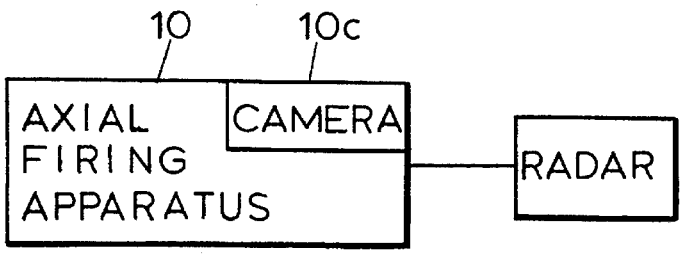
FIGS. 4, 5A–5B and 6 schematically show various features of the invention.
Figure 5A:
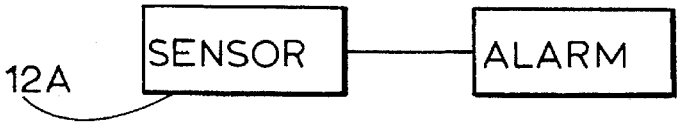
Figure 5B:
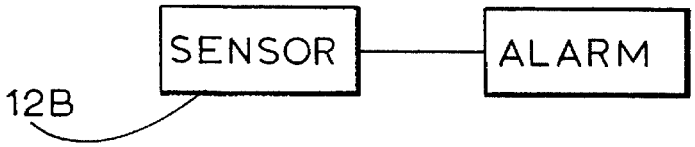
Figure 6:
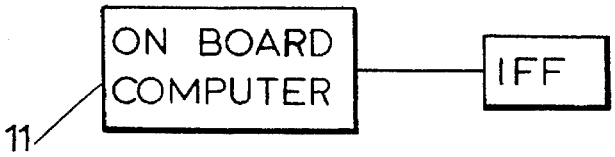

The main sensor of the axial firing apparatus is a thermal camera 10*c* (schematically shown in FIG. 4) having two simultaneous fields making it possible to obtain two images by using a single detection module in time division (FIG. 3):

- a large field image 23 (typically 40° by 30° with ×1 magnification) that is not steerable, that lies on the axis of the helicopter and that serves to acquire targets 24, 25 directly or by designation from the observation apparatus 9 [different symbologies (marker symbols) are used for targets in the air 24 and on the ground 25]; and
- a small field image at large magnification 26 (typically 1° and ×10) that is steerable and that is overlaid within the large field for the purposes of identifying and engaging a determined target 27 at long range.

Automatic multi-target tracking operating on either of the two images is possible and indeed necessary to ensure overall effectiveness of the proposed sighting system.

The axial fire apparatus 10 has all the functions required for controlling air-to-air and air-to-ground optoelectronic firing.

Firstly, it must be possible to acquire targets on the axis of the helicopter either:

- directly, which requires the presence of a large field, similar in size to the field used by the pilot (typically 40° by 30°) and at magnification of ×1, to ensure continuity with direct outside visual observation; and
- on the basis of a target being designated by the observation apparatus 9, using appropriate symbology that appears on the axis of the helicopter and that is particularly suitable for use with a mode in which the helicopter axis is swung onto the target.

In addition, after acquisition, long-range identification must be possible without losing the essence of the large field. Identification requires a small field at large magnification (typically 1° and ×10) that is steerable within the main field (typically 40° by 30°).

Two images may be acquired simultaneously using conventional means (such as those described, for example, in the document "Multiple function FLIR—a second generation pilotage and targeting system": Symposium AGARD-CP411, "Advances in Guidance and Control Systems and Technology", 7–10 Oct. 1986, London), using a single detection module that time shares each of two optical paths. On a display, the small-field enlarged image may be shown either by being overlaid on the large field, on top of the detection location, or else on a "head-down" display screen.

This provides a degree of multi-target capacity, by rapid sequential processing of detected targets. Since the essential function of this apparatus is firing, the 8 micrometer to 12 micrometer band appears to be the most appropriate. Insofar as the large field image is compatible with piloting, the use of a 0.45 micrometer to 0.9 micrometer sensor may also be envisaged.

Weapons are used on the basis of the large field image or of the small field overlay, after telemetry and acquisition of automatic tracking, and by means of guidance equipment specific to the weapons.

It is advantageous to group the various equipments for controlling firing on the axis within a common "nest" provided for this purpose in the structure of the helicopter. Having the equipment close together makes it possible to envisage operations of harmonizing their aiming axes, in the same type of manner as is used at present between the various optical paths of a gyrostabilized platform.

The positions that the various equipments occupy on the structure may be the same as the present locations of gyrostabilized platforms (nose, roof).

The reductions in mass and bulk that result from this new architecture also make it possible to envisage mounting sensors at locations that facilitate reducing environmental constraints (mainly concerned with vibration and aerodynamics) in ways that have been impossible in the past for platforms that are gyrostabilized.

The observation first apparatus 9 performs some of the functions that have been traditionally the responsibility of the vehicle commander in his role of controlling the mission and seeking targets. It also makes short range reflex engagement of highly off-axis targets possible for self-protection or for opportunistic firing.

The observation function combines two types of tasks:

- an automatic omnidirectional watch-keeping task both air-to-air and air-to-ground in which space is scanned systematically for the purpose of detecting targets; and
- a task of observation in a small field that can be steered by pointing a telescope, similar to the task generally performed by the commander when seeking targets. Pointing a telescope also makes it possible to confirm detection as performed automatically by the omnidirectional watch-keeping to a defined level of recognition and identification.

In addition, acquisition requires angles and distances to be measured in order to designate targets to the automatic directors of missiles and to the axial firing control system.

Nevertheless, it must be possible under certain conditions for the acquisition phase to be concluded by firing certain weapons (turret-mounted cannon, air-to-air missiles) for engagement at short range without it being essential to go through a stage during which the helicopter axis is swung onto the target and the target is taken over by the system for controlling firing on the axis.

Such short-range engagement implies that targets must be identifiable at short range, optionally by using magnification or else by an identification friend or foe (IFF) procedure. In general, this function will hardly ever be used insofar as engagement will normally take place at distances that are short enough to enable visual identification. For controlling cannon fire, it is also necessary to generate commands for pointing and servo-controlling the turret, while a latch-on function is also required for air-to-air missiles. Swinging the helicopter axis onto the target, optionally by means of a special automatic pilot mode, may also be required for using axial weapons at short range that are steerable in elevation (cannons, rocket launchers).

The axial fire second apparatus 10 constitutes a multi-weapon fire control system made available both to the pilot and to the commander, and because of its high performance in accuracy and in range it is capable of implementing all of the weapons of the helicopter over the entire field in which they can be fired.

Compared with ordinary aiming means, difficulties concerned with suitability for fitting onboard can be reduced because of the limitation on the front sector of the angular coverage. This limitation which is well compensated by the omnidirectional ability of the observation first apparatus 9 has no ill-effects on the overall effectiveness of the system, particularly since most engagements that require the accuracy of such fire control take place on axis or can accept a certain amount of time as is required to bring a target onto the axis, i.e. swinging the helicopter axis onto the target.

As already mentioned, this principle makes it possible to install the various elements of fire control (infrared detectors, camera, telemeters, weapons guidance equipment, inter alia) directly on the structure of the helicopter and not on a gyrostabilized platform, for example. This architecture imparts a modular nature to the system enabling the helicopter to be configured rapidly for a specific mission and a given weapon, by installing appropriate detectors and guidance equipment, and to reduce constraints on the integration and harmonization of the equipment on the helicopter.

Direct acquisition of targets is possible by the axis fire control system. Acquisition may be performed by the pilot, as is used with a "head-up display" sight (Schematically shown at 31 in FIG. 1) or a brilliant sight for short-range self-protection firing of an air-to-air missile or of the cannon. In contrast, taking on and engaging targets at long range (air-to-air and air-to-ground) is done in conventional manner by the commander (firer).

In order to enable the axial fire control system to take over targets that have been detected by the observation first apparatus 9, it is necessary to have a target designating function that operates between the observation apparatus 9 and the axial fire apparatus 10, and that takes place via the onboard computer 11. Acquisition is then performed in the same manner as for direct detection, after the helicopter has been swung onto the direction of the detected target.

At long range, the performance of the observation apparatus 9 may not always be sufficient to achieve identification. Under such conditions, ambiguity can be lifted by swinging the helicopter axis and by the target being taken over by the axial fire apparatus 10 (axial fire control system), and this is possible up to the maximum identification range of the system overall.

Furthermore, the telemetry function is brought into play immediately prior to using a weapon. This may be done in several different ways: stadiometry, triangulation, telemetry.

The firing control function relates to using the weapons. It must be compatible with as large a number as possible of weapons and it must make all modes and commands associated with their use available (automatic tracking, manual remote pointing). In particular, it must be possible to integrate the specific guidance equipment of such weapons (distance measurers, laser lighting, alignment laser beam generator). The performance required for using the weapons at long range makes it necessary for a harmonization function to be present.

The display chosen naturally depends on the functional analysis of the observation apparatus 9 and of the axial firing apparatus 10.

The functions of the observation apparatus mean that it will be controlled and observed by a helmet-mounted visual sighting system (head-up display) that is rapid without requiring great range and pointing accuracy. In this configuration, the treatment of detections in automatic mode may give rise to symbology of the order-directing type (up/down, left/right, elevation/bearing) for manual acquisition and observation on such a sight by the operator turning his head or by the helicopter swinging onto the target so as to make it possible for axial fire control to take over.

The functions of the axial firing apparatus can be performed entirely in the 8 micrometer to 12 micrometer band by a camera having two simultaneous fields. The display suitable for this function may be a head-up display. In this configuration, the use of a brilliant sight is not possible in the present state of the art, insofar as the intensity of the infrared image delivered by the monitor runs the risk of being insufficient to be superposed under good conditions on all possible levels of light background that may be encountered.

In addition, the display of said head-down sensor encounters two drawbacks:

it constrains the operator to move his eyes away from the outside environment, which can make it difficult simultaneously to perform the task of piloting the helicopter; and in the present state of technology, it requires the use of a special monitor having adequate resolution as is not yet available on multiple-function screens.

Consequently, an appropriate solution would appear to be a "head halfway" sight. That is to say by using a monitor through magnifying optics the pilot and/or the commander is presented with an infrared optoelectronic image of the outside world on the axis of the helicopter. This display is situated in the cockpit in a halfway position, and unlike a brilliant sight, it does not enable the direct image of the outside world to be seen.

Target detection coming from the observation apparatus or from the axial fire apparatus generates symbology that is superposed on the optoelectronic image of the outside world (marker symbols, results of friend/foe identification interrogation, telemetry) enabling the operator to engage them in sequence and in an order of priority. To do this, the operator displaces a cursor over the "head halfway" screen, selects where necessary the aperture of the magnifying window, within which automatic tracking can be performed and fire can be performed, by latching on of the autodirectors of air-to-air or air-to-ground missiles, guidance being taken over by passive rangefinders, director laser beams or illuminators, used for controlling fire (cannon or rockets).

A simplified version of the axis fire apparatus may also be envisaged in which there is no optoelectronic image on the axis. Under such circumstances, only the firing symbology is present on the head-up brilliant sight. In which case, the infrared image of the outside world exists but it is not displayed. It is made use of solely by the detection and automatic tracking computers that generate the corresponding symbology which is directly superposed on the transmitted image of the outside world. In particular, the overlaid zoom function need not be implemented. In contrast, the steerable small field image may be displayed and used on a "headdown" screen in the infrared or in the visible, depending on which sensors are in use.

Furthermore, the targets detected by the first observation device may be memorized for subsequent analysis, e.g. in the onboard computer 11 of the aircraft. In addition, alarms may be associated with the observation first apparatus that are active for fire control purposes, while symbology using different colors may be used as a function of the results of the identification friend or foe (IFF) procedure.

I claim:

1. A sighting system for an aircraft, comprising in combination:

an onboard computer;

observation means, integrated in the sides of the aircraft, for automatically detecting air and ground targets and for observing a field telescopically with determined magnification to recognize targets and to confirm detection thereof; and sighting means, integrated at the front of the aircraft, for acquiring a target, said observation means and said sighting means being connected to said onboard computer of the aircraft, said sighting means comprising:

means for generating a large field image that is not steerable, that lies on an axis of the aircraft, and that serves to acquire targets directly or by designation from said observation means; and means for generating a small field image that is steerable and that is overlaid within said large field image to identify and engage a target at long range.

2. A sighting system according to claim 1, wherein said observation means comprises two sensors integrated directly on the fuselage of the aircraft on respective opposite sides of its longitudinal axis, each covering about 180° in relative bearing and 20° to 40° in elevation.

3. A sighting system according to claim 1, wherein said sighting means is integrated in the nose of the aircraft.

4. A sighting system according to claim 1, wherein said sighting means is integrated in the aircraft above its cockpit.

5. A sighting system according to claim 1, wherein said sighting means comprises a thermal camera having two simultaneous fields, namely a large field for acquiring targets, and a small field for identifying and engaging a determined target at long range.

6. A sighting system according to claim 1, wherein said observation means and said sighting means operate in the 8 micrometer to 12 micrometer band.

7. A sighting system according to claim 6, wherein said observation means also operates in the 3 micrometer to 5 micrometer band.

8. A sighting system according to claim 6, wherein said observation means also operates in the 0.45 micrometers to 0.9 micrometer band.

9. A sighting system according to claim 6, wherein said observation means is associated with a radar.

10. A sighting system according to claim 1, including means for memorizing targets detected by said observation means.

11. A sighting system according to claim 1, including alarms associated with said observation means and active for fire control purposes.

12. A sighting system according to claim 1, additionally comprising sensors operating in the infrared or in the visible spectrum which enable the aircraft to be piloted in fire control mode.

13. A sighting system according to claim 1, wherein said sighting means presents a head-up display.

14. A sighting system according to claim 13 wherein fire symbology is displayed on its own on a head-up display.

15. A sighting system for an aircraft, comprising in combination:

an onboard computer;

observation apparatus integrated in the sides of the aircraft; and axial fire apparatus integrated at the front of the aircraft, said apparatuses being connected to said onboard computer of the aircraft, wherein the observation apparatus comprises two sensors integrated directly on the fuselage of the aircraft on respective opposite sides of its longitudinal axis, each covering about 180° in relative bearing and 20° to 40° in elevation, wherein each sensor has a plurality of elementary detectors, and includes first optical scanning means comprising a bearing scanning prism enabling a bearing scan sheet to be obtained, and a prism for tilting said sheet enabling elevation scanning to be performed.

16. A sighting system according to claim 15, wherein each sensor includes a second optical system enabling a fraction of the total field to be scanned, which second optical system comprises a bearing scanning mirror rotating at low speed and a retractable lens.

17. A sighting system according to claim 15, wherein said axial fire apparatus is integrated in the nose of the aircraft.

18. A sighting system according to claim 15, wherein said axial fire apparatus is integrated in the aircraft above its cockpit.

19. A sighting system according to claim 15, wherein said axial fire apparatus comprises a thermal camera having two simultaneous fields, namely a large field for acquiring targets, and a small field for identifying and engaging a determined target at long range.

20. A sighting system according to claim 15, wherein said observation apparatus and said axial fire apparatus operate in the 8 micrometer to 12 micrometer band.

21. A sighting system according to claim 20, wherein said observation apparatus also operates in the 3 micrometer to 5 micrometer band.

22. A sighting system according to claim 20, wherein said observation apparatus also operates in the 0.45 micrometers to 0.9 micrometer band.

23. A sighting system according to claim 20, wherein said observation apparatus is associated with a radar.

24. A sighting system according to claim 15, including means for memorizing targets detected by said observation apparatus.

25. A sighting system according to claim 15, including alarms associated with said observation apparatus and active for fire control purposes.

26. A sighting system according to claim 15, additionally comprising sensors operating in the infrared or in the visible spectrum which enable the aircraft to be piloted in fire control mode.

27. A sighting system according to claim 15, wherein said axial fire apparatus presents a head-up display.

28. A sighting system according to claim 27, wherein fire symbology is displayed on its own on a head-up display.

* * * * *